United States Patent [19]

Lynch et al.

[11] Patent Number: 4,499,441

[45] Date of Patent: Feb. 12, 1985

[54] SUPERCONDUCTING SIGNAL PROCESSING CIRCUITS

[75] Inventors: John T. Lynch, Cambridge; Alfredo C. Anderson, Watertown; Richard S. Withers, Bedford, all of Mass.; Peter V. Wright, Dallas, Tex.

[73] Assignee: Massachusetts Institute of Technology, Cambridge, Mass.

[21] Appl. No.: 434,431

[22] Filed: Oct. 14, 1982

[51] Int. Cl.[3] ..... H01P 1/203; H01P 9/00; H01P 5/18

[52] U.S. Cl. ..... 333/161; 333/99 S; 333/116; 333/165; 333/246; 333/204

[58] Field of Search ..... 333/99 S, 116, 202, 204, 333/206, 207, 156–163, 236, 238, 245, 246, 23, 166

[56] References Cited

U.S. PATENT DOCUMENTS

| | | | |
|---|---|---|---|
| 2,916,615 | 12/1959 | Lundburg | 333/99 S |
| 3,163,832 | 12/1964 | Nahman et al. | 333/99 S |
| 3,191,055 | 6/1965 | Swihart et al. | 333/99 S X |
| 3,548,073 | 12/1970 | Nishino et al. | 333/99 S X |
| 3,768,042 | 10/1973 | Friend et al. | 333/116 |
| 3,768,046 | 10/1973 | Lorber et al. | 333/166 X |
| 4,921,286 | 9/1981 | Wagner | 333/202 X |

OTHER PUBLICATIONS

Mueller et al., "A Wide-Band Microwave Compressive Receiver", 1962 IRE International Convention, pp. 103–115.

Blair et al., "Fabrication of RF Niobium-on-Sapphire Superconducting Resonators", Rev. Sci. Instrum., 50(3), Mar. 1979, ©1979 American Institute of Physics, pp. 279–285.

Connell–"Laminar Superconducting Delay Line", IBM Technical Disclosure Bulletin, vol. 5, No. 1, Jun. 1962, p. 23.

Mason, "Effect of Tin Additive on Indium Thin-Film Superconducting Transmission Lines", Journal of Applied Physics, vol. 42, No. 1, Jan. 1971, pp. 97–102.

"Reference Data for Radio Engineers", Fifth Edition, Howard Sams and Co., New York, 1968, pp. 4–23.

*Primary Examiner*—Marvin L. Nussbaum

*Attorney, Agent, or Firm*—Arthur A. Smith, Jr.; Thomas J. Engellenner

[57] ABSTRACT

A superconducting transversal filter circuit for processing signals in the 2–20 GHz range consisting of a miniature transmission line of niobium or similar material, a series of taps for coupling the input and output, and cryogenic refrigerator.

25 Claims, 7 Drawing Figures

FIG. 1a
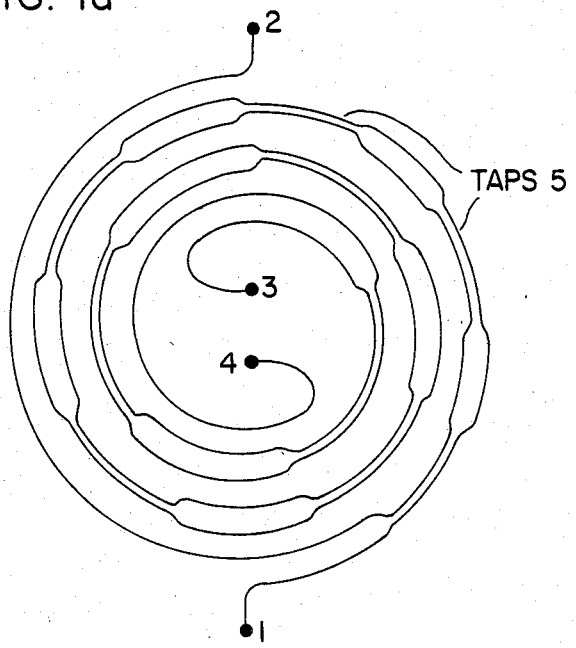
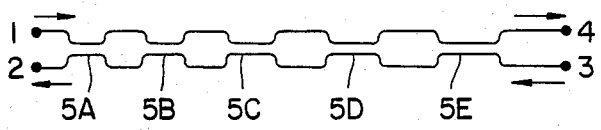
FIG. 1b

SUPERCONDUCTING PROXIMITY-TAPPED DELAY LINE
3-5 GHz, 27-ns UPCHIRP

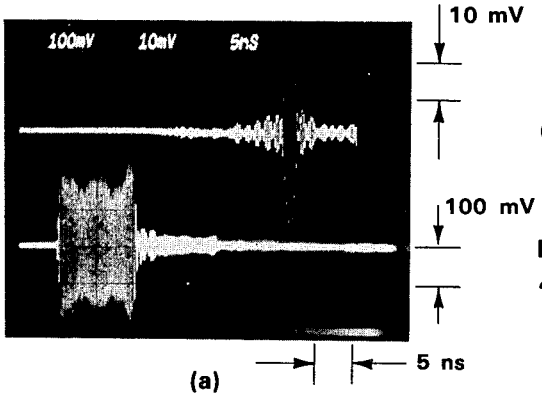
COMPRESSED PULSE OUTPUT FIG.3a
EXPANDED PULSE INPUT
4200-3400 MHz DOWNCHIRP FIG.3b
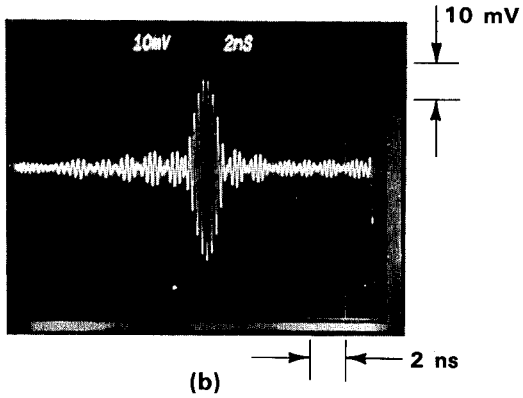
ENLARGED VIEW OF
COMPRESSED PULSE FIG.3c

SUPERCONDUCTING SIGNAL PROCESSING CIRCUITS

TECHNICAL FIELD

This invention relates to signal processing devices and, in particular, to transversal filter circuits operating in the 2 to 20 gigahertz range.

BACKGROUND OF THE INVENTION

The government has rights in this invention pursuant to Air Force and Army Contract No. AF19628-80-C-0002.

Attention is directed to an article by the inventors and a colleague entitled "Passive Superconducting Microwave Circuits for 2–20 GHz Bandwidth Analog Signal Processing" *Proc. of the IEEE Int'l. Microwave Symposium* (June 15, 1982), hereby incorporated by reference.

The use of signals in 2–20 GHz range has become increasingly important in communications and radar. Consequently, construction of signal processing devices such as matched filters and linear phase filters, in particular, has become a goal for researchers.

At lower bandwidths various signal processing devices have been constructed that yield high time-bandwidth (TW) products. For example, analog discrete-time devices with bandwidths up to 20 MHz have been made with charge-coupled devices (CCDs); analog continuous-time devices with bandwidths up to 1000 MHz (1 GHz) have been made using surface-acoustic-wave (SAW) devices; and recent research effort has explored acoustooptic (A/O) devices and magnetostatic wave (MSW) devices, both with bandwidths of about 1 GHz. The propagating wave velocities in these devices are substantially below the speed of light; thus one can achieve large interaction times in relatively compact forms. However, a host of physical limitations such as propagation loss, dispersion, and transducer inefficiency prevents the practical utilization of these techniques at bandwidths above 2 GHz.

Elctromagnetic delay lines offer bandwidths of tens of gigahertz, well beyond those realizable with acoustic delay lines or sampled data structures such as CCDs. However, the high electromagnetic velocity requires the use of long lines to achieve significant delay. For example, a 100 ns device would require about 30 meters of free space delay or about 10 meters if the medium had a dielectric constant of 10. This length of coaxial cable or waveguide would be physically cumbersome. Such a delay also could be achieved with a copper microstrip delay line on low-loss 0.4-mm thick alumina substrate and would require an area of about 500 $cm^2$. However, for 5-GHz bandwidth operation centered at 10 GHz, it would have a loss of about 40 dB at room temperature. Thicker substrates would give lower losses but would require larger area for a given delay. Because of this trade-off of large area or high loss, conventional electromagnetic delay technology has been unsuitable for microwave signal processing to date.

Nonetheless, there exists a need for signal processing devices in the 2–20 GHz range and electromagnetic delay lines constructed using microfabrication processing techniques would be particularly valuable as components in large scale integrated circuits. Specifically there exists a need for matched filters, in particular, "upchirp" and "downchirp" filters, and linear phase filters.

SUMMARY OF THE INVENTION

We have discovered that processing devices for signals in the 2–20 GHz range can be constructed using the principles of electromagnetic delay lines and microfabriciation techniques and can be effective as signal processors by operating the devices at low temperatures in a superconducting mode. Extremely long lines can be formed into a small package without prohibitive insertion losses by using materials such as niobium at 4.2° K. Such conductors can be used to fashion transversal filter structures of high signal processing capacity. The transversal filters consist of transmission lines and taps. The presently preferred tapping method employs an array of backward-wave couplers, each of which couples energy propagating in the forward direction on the input line to a backward-propagating wave on the output line.

We have demonstrated that by using a rugged refractory superconductor such as niobium, which at 4.2° K. and 3 GHz has a surface resistivity of about 0.01% that of copper at room temperature, one can make very narrow microstrip or stripline microwave transmission lines and hence pack extraordinarily long delay on easy-to-handle 5-cm-diameter substrates. We have made lines which are 2.5 meters long, and lines which are 100 meters long appear feasible. Because stripline has insignificant dispersion and the conductor and dielectric loss are approximately independent of bandwidth, for fixed time-bandwidth product, the major bandwidth constraint is imposed by the coaxial cable and coax-to-stripline transitions at the input and output of the device.

Recent advances in refrigeration apparatus make our microstrip devices commercially viable. Low cost, efficient refrigerators operating at 4.2° K. and requiring only a few kilowatts of power can be employed as the means for cooling the transmission lines of our devices.

Our invention will next be described in connection with certain preferred embodiments; however, it should be clear that those skilled in the art can make various modifications and changes to our invention without departing from the spirit or the scope of the claims. For example, our invention may be used to process frequency-modulated signals, phase-modulated signals or amplitude-modulated signals or a combination of these types of modulation. Our devices may be used as matched filters or vice versa as the generator of a particular wave form. While linear upchirp and downchirp filters are described in detail, non-linear chirp filters and circuits designed for unique wave forms are also contemplated.

Moreover, while niobium has been chosen as a preferred material for the transmission line, other superconducting materials such as lead, niobium alloys (such as niobium-tin) and the vanadium alloys (such as vandium-silicon) as well as other superconductors may also be used. The line widths for the transmission lines may vary from 50 to 5 microns and could be made even thinner with ongoing advances in the field of microfabrication. The length-to-width aspect ratio may vary from $10^5$ to $10^7$ in typical devices and may be even greater if desired for a particular application.

Additionally, our transmission lines may take various geometric shapes. In addition to the double spiral shown in our preferred embodiment, quadruple spirals may also be employed. Single spirals with one terminal at the center could also be used for particular applications. For other applications, a meandering line might be preferred. While we have described a device in which separate input and output channels are connected by backward coupling proximity taps, another embodiment could employ a single line with backward coupling achieved by expansion of the line width at predetermined locations to achieve the same energy tapping function. Additionally, various other substrates may be used besides sapphire, for example, silicon and quartz; and less powerful refrigerators (for example, refrigerators operating at about 10° K.) could be employed with other superconducting materials and substrates.

BRIEF DESCRIPTION OF THE DRAWINGS

FIG. 1*a* is a schematic diagram of a double-spiral embodiment of our invention.

FIG. 1*b* is a schematic diagram of the tap spacing of our invention.

FIG. 3*a* is a photograph showing the output of an upchirp filter.

FIG. 3*b* is a photograph showing the output of a downchirp filter.

FIG. 3*c* is an enlarged view of the compressed pulse of FIG. 3*a*.

DESCRIPTION OF THE PREFERRED EMBODIMENTS

Figure 2B:
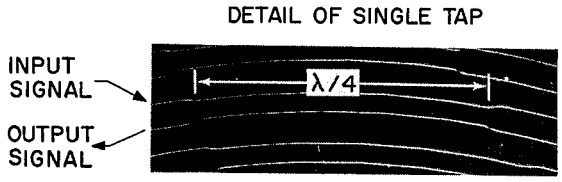
FIG. 2*b* is an expanded view of a portion of FIG. 2*a*.

In FIG. 1*a* a schematic view of one embodiment of our invention performing a downchirp filtering function is shown. Microwave energy entering the device through input port 1 is selectively coupled to output port 2 by taps 5. The inner ends of the double spiral 3 and 4 are preferably terminated in the characteristic impedance of the device (i.e., 50 ohms). In FIG. 1*b* the frequency selectivity of the downchirp filter can be seen; tap 5*a* closest to the input and output permits high frequencies (typically generated at the end of an upchirp signal or present in an exciting impulse) to "jump tracks" first while lower frequencies must pass further down the line before they reach a compatible coupling point (i.e., 5*b*, 5*c*, etc.). If the input is the matching upchirp the net result at output 2 is a substantially compressed signal.

As can be seen from FIG. 1*b*, the same filter can be run backward (by using terminals 3 and 4 as input and output, respectively) to produce an upchirp filter. Alternatively, a separable device with the reversed order of tap lengths and spacing may be fabricated to produce an upchirp filter. Where both an upchirp and downchirp circuit are to be used in tandem a quadruple spiral design with all the terminals located at the outer edge of the wafer may be employed.

Figure 2A:
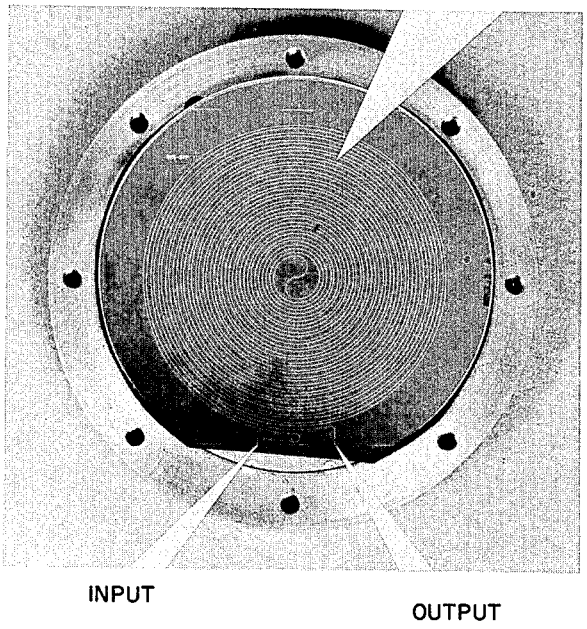
FIG. 2*a* is a photograph of a upchirp filter built according to our invention.

In FIG. 2*a* an actual upchirp device is shown. This linear-FM dispersive delay line gave 27 ns of dispersion over a 2 GHz bandwidth centered on 4 GHz. The stripline structure comprised a 2000-Å-thick patterned niobium film sandwiched between two 2"-diameter, 5-mil-thick sapphire wafers with surrounding niobium ground planes. The pattern consisted of two parallel lines wound in a spiral pattern. The input lines was coupled to the output line at prescribed points by bringing the two lines into and out of closer proximity, thereby forming quarter-wavelength-long backward-wave couplers (see FIG. 2*b*). The resonant frequency of the couplers was designed to be a linear function of distance along the line pair, producing the desired linear group delay-vs-frequency relation, in this case an upchirp. The couplers in this device were not amplitude-weighted, so that the magnitude of the frequency response increased linearly with frequency. A matching device, identical except for the sign of the delay-vs-frequency slope, was also fabricated.

A 200-mV dc step with a 25-ps risetime was applied to the input of the expander, in this case the downchirp device. The resulting 27-ns long linear-FM pulse is amplified and time-gated, producing the pulse shown in FIG. 3*b*. This is applied to the input of the compressor, the upchirp device. The resulting compressed pulse is displayed in FIG. 3*a*. Expanded in time, this same pulse is also shown in FIG. 3*c*.

We claim:

1. A superconducting transversal filter circuit for processing analog signals, the circuit having an input channel and an output channel and further comprising;

(a) a miniature transmission means for delaying the signal from the input channel to the output channel the transmission means comprising;

(i) an essentially planar substrate;

(ii) an input line connected to the input channel and disposed upon the substrate; and (iii) an output line connected to the output channel and also disposed upon the substrate in a spaced-apart but proximal relation to the input line;

(b) a cooling means for cooling the input and output lines of the transmission means to a temperature where superconduction is achieved; and (c) a plurality of tap means integrally formed with the transmission means for tapping transmission means at predetermined locations, each tap means providing a coupling between the input and output lines of a particular strength at a particular location whereby the plurality of tap means, in concert, provide signal processing.

2. The filter circuit of claim 1 wherein the filter circuit is a matched filter for a particular waveform and the plurality of tap means further comprise a plurality of tap means for tapping the transmission means at predetermined locations, the spacing between tap means and their relative strengths being chosen such that only a signal with a particular waveform is processed through the filter with relatively low loss.

3. The filter circuit of claim 1 wherein the filter circuit is a matched filter for a frequency modulated signal and the plurality of tap means further comprise a plurality of tap means for tapping the transmission means at predetermined locations, the spacing between the tap means and the relative strengths being chosen such that different frequency components undergo different delays in transmission.

4. The filter circuit of claim 3 wherein the matched filter circuit is a linear frequency modulated circuit and the plurality of tap means further comprise a plurality of tap means chosen such that the delay imparted to different frequency components of the signal is a linear function of frequency.

5. The filter circuit of claim 3 wherein the matched filter is an upchirp filter circuit and the plurality of tap means further comprise a plurality of tap means chosen such that the delay imparted to different components of the signal is an increasing function of frequency.

6. The filter circuit of claim 3 wherein the matched filter circuit is a downchirp filter circuit and the plurality of tap means further comprise a plurality of tap means chosen such that the delay imparted to the different frequency components of the signal is a decreasing function of frequency.

7. The filter circuit of claim 1 wherein the input line and the output line of the transmission means are composed of at least one material chosen from the group of: niobium, lead, vanadium-silicon alloys, and niobium-tin alloys.

8. The filter circuit of claim 7 wherein the input line and the output line of the transmission means are composed of niobium.

9. The filter circuit of claim 7 wherein the input and output lines each have a defined width ranging from about 5 to about 50 microns.

10. The filter circuit of claim 7 wherein the input line and the output line each have a defined length and a defined width, the length-to-width aspect ratio ranging from about $10^5$ to about $10^7$.

11. The filter circuit of claim 1 wherein the transmission means is a compact geometric design laid down on a substrate.

12. The filter circuit of claim 11 wherein the compact geometric design is a double spiral.

13. The filter circuit of claim 11 wherein the compact geometric design is a quadruple spiral.

14. The filter circuit of claim 11 wherein the compact geometric design is a single spiral.

15. The filter circuit of claim 11 wherein the compact geometric design is a meander line.

16. The filter circuit of claim 1 wherein the transmission means is a superconducting material laid down upon a substrate chosen from the group of sapphire, silicon, and quartz.

17. The filter circuit of claim 16 wherein the substrate is sapphire.

18. The filter circuit of claim 1 wherein the cooling means is a cooling means for cooling the transmission means down to about 10° K. or less.

19. The filter circuit of claim 18 wherein the cooling means is a cooling means capable of cooling the transmission means down to a temperature of about 4.2° K. or less.

20. The filter circuit of claim 1 wherein the filter circuit is a linear phase filter circuit and the plurality of tap means further comprise a plurality of tap means chosen such that phase shift through the device is linear function of frequency.

21. The filter circuit of claim 1 wherein the plurality of tap means are formed by varying the separation between the input and output lines.

22. The filter circuit of claim 1 wherein a processed signal is generated on the output line and propagates in a direction opposite to the signal travelling along the input line as a result of coupling between the input line and output line at each tap means.

23. A superconducting transversal filter circuit for processing analog signals, the circuit having an input channel and an output channel and further comprising;

(a) a miniature transmission means for delaying the signal from the input channel to the output channel, the transmission means comprising:
  (i) an essentially planar substrate; and
  (ii) a line of a superconductive material connected to both the input channel and the output channel at one end and disposed upon the substrate;
(b) a cooling means for cooling the line of the transmission means to a temperature where superconduction is achieved; and
(c) a plurality of tap means integrally formed with the transmission means for tapping the transmission means at predetermined locations, each tap means providing a means for reflecting a portion of the signal back along said line at a particular strength at a particular location, whereby the plurality of tap means, in concert, provide signal processing.

24. The filter circuit fo claim 23 wherein the superconducting line of the transmission means has a defined width and the tap means are formed by varying said width.

25. A superconducting transversal filter circuit for processing frequency modulated signals in the 2–20 gigahertz range, the circuit having an input channel and an output channel and further comprising;

(a) a miniature transmission means for delaying the signal from the input channel to the output channel, the transmission means comprising:
  (i) an essentially planar substrate;
  (ii) an input line of a superconductive material connected to the input channel and disposed upon the substrate; and
  (iii) an output line of a superconductive material connected to the output channel and also disposed upon the substrate in a spaced-apart but proximal relation to the input line;
(b) a cooling means for cooling the input and output lines of the transmission means to a temperature where superconduction is achieved; and
(c) a plurality of tap means integrally formed with the transmission means for tapping the transmission means at predetermined locations, each tap means providing a coupling between the input and output lines of a particular strength at a particular location, the spacing between the tap means and the relative strengths being chosen such that different frequency components undergo different delays in transmission.

* * * * *